US005102386A

United States Patent [19]

Wessel et al.

[11] Patent Number: 5,102,386

[45] Date of Patent: Apr. 7, 1992

[54] HOLLOW FORMING BLOCKS FOR DOUBLE PACKAGE FORMING MACHINES

[75] Inventors: Valerian H. Wessel, Brooklyn Park; Floyd Lobash, Minneapolis; Wayne I. Knigge, Maple Grove, all of Minn.

[73] Assignee: General Mills, Inc., Minneapolis, Minn.

[21] Appl. No.: 588,258

[22] Filed: Sep. 26, 1990

[51] Int. Cl.[5] ..... B31B 7/00

[52] U.S. Cl. ..... 493/472; 493/93; 493/98; 493/101; 493/183

[58] Field of Search ..... 493/93, 95, 96, 98, 493/100, 101, 163, 164, 175, 176, 472, 165, 183, 184, 474; 53/563

[56] References Cited

U.S. PATENT DOCUMENTS

| | | | |
|---|---|---|---|
| 736,780 | 8/1903 | Reynolds | 493/93 |
| 977,698 | 12/1910 | Barksdale | 493/175 X |
| 1,253,007 | 1/1918 | Corwin | 493/93 |
| 1,528,073 | 3/1925 | Phillips | 493/93 |
| 2,249,431 | 7/1941 | Moeller | 493/183 X |
| 2,380,913 | 8/1945 | Bennett | 493/101 |
| 2,974,571 | 3/1961 | Windstrup et al. | 493/93 X |
| 3,252,386 | 5/1966 | Reimers | 493/141 X |
| 3,408,906 | 11/1968 | Heffelfinger et al. | 493/141 X |
| 3,910,169 | 10/1975 | Coburn et al. | 493/105 |
| 4,302,275 | 11/1981 | Burmeister et al. | 493/472 X |
| 4,493,682 | 1/1985 | Bryson et al. | 493/472 X |
| 4,682,974 | 7/1987 | Sun | 493/183 X |
| 4,723,935 | 2/1988 | Furukawa | 493/100 |

*Primary Examiner*—Bruce M. Kisliuk
*Assistant Examiner*—John A. Marlott
*Attorney, Agent, or Firm*—John A. O'Toole

[57] ABSTRACT

An improved forming block (10) is described for forming double packages including a liner enclosed within a carton. The forming block (10) includes a mandrel (12) having a free, open end (30) partially closed by an end piece (14). The mandrel (12) includes a hollow core (16) having a periphery around which the double package is formed. The mandrel (12) further includes a mounting bracket (18) which mounts the mandrel (12) in a cantilever manner to the forming machine and includes a hollow interconnecting portion (20). Ambient air is in communication to the interior of the core (16) by apertures (56) formed in the interconnecting portion (20). Air communication is also provided from the interior of the core (16) and the interior of the double package through apertures (76) formed in the end piece (14) and through vent holes (40) formed in the core (16) adjacent the open end (30). Longitudinal grooves (34) are formed in each of the sides (22, 24) of the periphery of the core (16) and corresponding to the hooks (36) of the stripper bars (38) for providing air communication between the liner of the double package and the mandrel (12) to provide communication of ambient air therealong and to allow movement of the stripper bars (38) without engaging the mandrel (12). In the preferred form, the vent holes (40) are located within and in air communication with the longitudinal grooves (34).

20 Claims, 1 Drawing Sheet

HOLLOW FORMING BLOCKS FOR DOUBLE PACKAGE FORMING MACHINES

BACKGROUND

The present invention generally relates to machines for forming double packages, and particularly to forming blocks utilized in double package forming machines, and more particularly to forming blocks allowing ease of stripping of double packages from the forming machines, with the double packages being intact and of a consistent quality.

A common method of packaging cereals and other foodstuffs is a double package comprising a liner enclosed within a carton. In the past, such liners were formed of glassine or wax paper, however, the use of plastic liners has been increasing because of the advantages obtained thereover. Specifically, plastic liners provide a better moisture seal to the food stuffs being packaged providing extended freshness without staleness. Additionally, plastic liners have a greater tendency to prevent tearing or ripping. A further benefit obtained is that the liner is more consumer friendly allowing the liner to be opened without tearing or ripping and allowing the liner to be resealed by the consumer to preserve freshness. Further, the cost of plastic liners tends to be relatively less than the cost of prior glassine or wax paper liners.

However, one difference between plastic and prior glassine liners is that plastic is structurally more flimsy and has a greater tendency to collapse. Collapse of the liner may disrupt the proper functioning of the remaining packaging operations including but not limited to the filling of food stuffs into the liner, the dropping of coupons or premiums inside of the liner, closing and sealing the liner, and like operations. One major cause of liner collapse is problems in removing the double package from the forming block.

A typical method of forming a double package is to rotate a forming block through a series of steps where the liner and carton are formed on and then removed from the forming block. An example of a double package forming machine and its method of operation is set forth in U.S. Pat. No. 2,364,406 issued on Dec. 5, 1944 to J.G. Vergobbi. Specifically, the liner material is cut and wrapped around the forming block and the upper edges are sealed together, which in the case of plastic liners are fin sealed by sealing the two edges of the liner material in a face to face manner. Next, the bottom of the liner is sealed together, which in the case of plastic liners again is fin sealed.

After the side and bottom of the liner are sealed, a pattern of adhesive is applied to a flat blank for forming the carton. In the case of plastic liners where heat is not required to seal the liner, hot melt adhesive may be utilized. The blank is wrapped around the liner located on the forming block and the side flap is clamped down on the side of the blank. Next, the bottom flaps are tucked in and the bottom of the blank is clamped against the liner located on the forming block. Pressure may be applied to crease the bottom corners of the carton to form a more stackable, stable carton, to spread and adhere the adhesive, and in the case of cold adhesive to cure the adhesive. It can be appreciated that adhesive may be applied to the blank to not only form the carton but also to attach the liner to the carton. The formed carton and liner is then stripped from the forming block by reciprocating a stripper bar relative to the forming block along a longitudinal path from beyond the free end of the forming block to beyond the top edges of the carton, and then moving the stripper bar back to hook the free edges of the top flaps and pull the carton and liner from the forming block for transport to other packaging operations when the stripper bar is moved back to beyond the free end of the forming block.

In pulling the carton and liner from the forming block, a piston effect is created by the forming block as the carton and liner formed therein are withdrawn from the forming block. This piston effect creates a vacuum inside of the liner between the liner and the forming block. The vacuum force has a tendency to collapse the liner especially when the liner was formed of plastic which is more flimsy than glassine or other liner material. Prior to the present invention, compressed air was forced through tubes extending to the bottom of the forming block to fill the void created in the liner as the forming block moved out of the liner and the carton to assist the removal of the liner and carton from the forming block. It can be appreciated that the introduction of compressed air had to be exactly timed with the movement of the stripper bars. Such timing is difficult to obtain especially at the speed of operation of such double package forming machines where between 50 to 60 double packages are formed per minute.

Accordingly, in the development of machines for forming double packages and especially double packages including plastic liners, it is imperative that the forming blocks prevent the collapse of the liner as well as deliver consistent, quality double packages.

Thus, it is an object of the present invention to provide a novel forming block for double package forming machines, with the double package including a plastic liner in the preferred form.

Another object of the invention is to provide a novel forming block including provisions for providing communication of ambient air to the interior of the liner of the double package to offset the vacuum potentially created when the double package is stripped from the forming block.

Yet another object of the invention is to provide a novel hollow forming block allowing ambient air flow to the interior of the hollow forming block to adjacent the free end of the forming block and at a rate to prevent the creation of a vacuum when the double package is stripped from the forming block.

Still further, another object of the invention is to provide grooves on the periphery of the forming block for providing communication of ambient air between the liner of the double package and the periphery of the forming block.

In another aspect of the present invention, a further object is to provide the periphery grooves corresponding to the longitudinal path of the hooks of the stripper bars to allow movement of the stripper bars without engaging the forming block.

SUMMARY

Surprisingly, the above objectives can be satisfied in the field of double package forming machines by providing in the preferred form, an improved forming block including a hollow core upon which the double package is formed, with communication of ambient air being provided to the interior of the core, through the core, and to the interior of the liner of the double package adjacent the free end of the core, with the air flow allowed being sufficient to prevent the creation of a vacuum within the double package while the double package is being stripped from the forming block.

In other aspects of the present invention, an improved forming block is provided including a longitudinal groove of a width at least equal to the width of the hook of the stripper bar and located on the forming block in the longitudinal path of the hook of the stripper bar to provide air communication between the liner of the double package and the forming block to offset the vacuum created when the double package is stripped from the forming block and allowing movement of the stripper bar without engaging the forming block.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
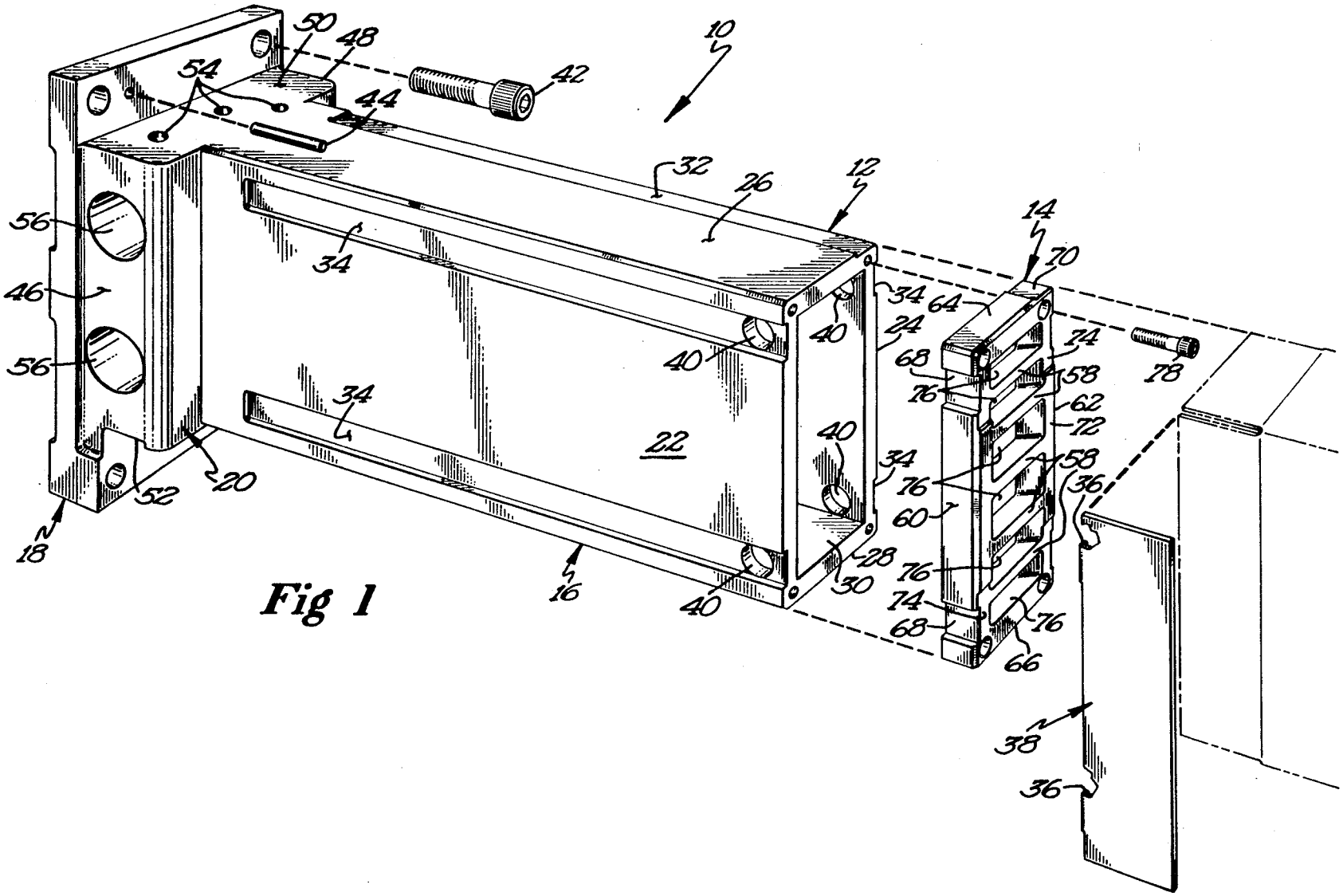
FIG. 1 shows an exploded perspective view of a forming block for use in a double package forming machine according to the preferred teachings of the present invention.

The figure is drawn for ease of explanation of the basic teachings of the present invention only; the extensions of the Figure with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the drawings, the same numerals designate the same or similar parts. Furthermore, when the terms "top", "bottom", "first", "second", "side", "edge", and similar terms are used herein, it should be understood that these terms have reference only to the structure shown in the drawings as it would appear to a person viewing the drawings and are utilized only to facilitate describing the invention.

DESCRIPTION

A forming block utilized in a double package forming machine for forming double packages for cereal, other food stuffs, or the like according to the preferred teachings of the present invention is shown in the drawings and generally designated 10. In the most preferred form, forming block 10 is formed by a generally hollow mandrel 12 having an attached end piece 14.

Mandrel 12 generally includes a core 16 upon which the carton and liner are shaped and formed, a mounting bracket 18 for attaching mandrel 12 to the double package forming machine, not shown, and an intermediate, interconnecting portion 20. Core 16 comprises a hollow parallelepiped including an outer periphery of a size and shape corresponding to the double package desired to be formed. The outer periphery of core 16 is defined in the most preferred form by two parallel sides 22 and 24 and by a top 26 and a bottom 28 arranged parallel to each other and joining sides 22 and 24, with top 26 and bottom 28 extending generally perpendicular to and between sides 22 and 24. Sides 22 and 24, top 26, and bottom 28 are solid in construction. The hollow interior of core 16 has a cross sectional area of a size substantial to the cross section of the double package desired to be formed, or in other words, the cross section of the outer periphery of core 16, and particularly the hollow interior of core 16 has a cross sectional area equal to the cross sectional area of the outer periphery of core 16 less the cross sectional area of sides 22 and 24, top 26, and bottom 28. The free edges of sides 22 and 24, top 26, and bottom 28 form an open end 30. In the most preferred form, sides 22 and 24, top 26, and bottom 28 have a slight taper inwardly towards end 30 and the outside corners at the interconnection of sides 22 and 24 with top 26 and bottom 28 are chamfered for ease of removal of the formed liner and carton from forming block 10. Top 26 includes a flap groove 32 extending from the interconnection of top 26 and side 24 of a size for receipt of the side flap attached to the back of the carton and which is secured to the side of the carton to allow the side of the carton to be generally flat in the formed carton.

Each of sides 22 and 24 of the periphery of core 16 include first and second, parallel, longitudinal stripper grooves 34 located parallel and adjacent to but spaced from the interconnections with top 26 and bottom 28 at locations corresponding to the longitudinal path of hooks 36 of stripper bars 38 of the double package forming machine, with grooves 34 having a width generally corresponding to hooks 36 of stripper bars 38 and particularly generally equal to or greater than hooks 36. Further, stripper grooves 34 have a longitudinal extent equal to the longitudinal extent of the longitudinal path of stripper bars 38 along mandrel 12. Prior forming blocks did not include stripper grooves and thus due to the close proximity of hooks 36 to the forming block necessary to catch on the free edges of the top flaps of the carton, hooks 36 were prone to engage the sides of the forming block when moving along their longitudinal path resulting in wear of hooks 36 and/or the sides of the forming block as well as metal filing contamination in the foodstuffs packaged in the formed double package. Grooves 34 allow hooks 36 to be located in very close proximity to sides 22 and 24 of mandrel 12 to insure hooking on the free edges of the top flap of the carton without engaging mandrel 12 to avoid the rubbing wear of prior double package forming machines. Further, grooves 34 provide forgiveness of any air trapped between the liner and sides 22 and 24 as will be explained further hereinafter.

Each of sides 22 and 24 include first and second, spaced, air vent holes 40 extending through the periphery of core 16 and located adjacent to but spaced from the interconnections with top 26 and bottom 28 and from end 30. In the preferred form, vent holes 40 are in air communication with stripper grooves 34. In the most preferred form, vent holes 40 have a diameter generally equal to the width of stripper grooves 34 and are located within the extent of stripper grooves 34.

Bracket 18 in the most preferred embodiment is in the form of a generally flat, rectangular plate of a size larger than interconnecting portion 20. In the perimeter of bracket 18 outside of interconnecting portion 20, suitable apertures are provided for receipt of mounting bolts 42 and position locking pins 44. Thus, bracket 18 mounts mandrel 12 of forming block 10 in a cantilever manner to the double package forming machine, with end 30 being free.

Interconnecting portion 20 may have any desired configuration such as the hollow parallelepiped configuration of the preferred form. In the preferred form, portion 20 includes two parallel sides 46 and 48 interconnected to a top 50 and a bottom 52 arranged parallel to each other and joining sides 46 and 48 together, with top 50 and bottom 52 extending generally perpendicular to and between sides 46 and 48. In the most preferred form, sides 46 and 48 have a thickness a multiple of times greater than sides 22 and 24 while top 50 and bottom 52 are approximately 50 thicker than top 26 and bottom 28. Top 50 and bottom 52 may include suitable mounting holes 54 for clamp bars or like apparatus for use in the double package forming machine, not shown. The hollow interior of interconnecting portion 20 has a cross sectional area of a size substantial to the cross section of the double package desired to be formed, and preferably of a cross sectional area generally equal to or larger than the cross sectional area of the hollow interior of core 16. In the preferred form, each of sides 46 and 48 include first and second apertures 56 providing air communication to the hollow interior of interconnecting portion 20 and core 16. Apertures 56 should have a total cross sectional area generally equal to or exceeding the cross sectional area of the hollow interior of interconnecting portion 20 and/or core 16. It can be appreciated that apertures 56 and the hollow interior of interconnecting portion 20 provides communication of ambient air to the hollow interior of core 16 of mandrel 12 and at an air flow rate generally equal to the air flow allowed through the hollow interior of core 16.

In the most preferred form, mandrel 12 is one piece and may be formed by two or more pieces permanently secured together such as by welding. Further, mandrel 12 is formed of cast aluminum which is surface hardened and having a release coat to allow ease of non-stick sliding of the liner on mandrel 12 and to allow ease of removal of any excess adhesive which should remain on mandrel 12. In the most preferred form, mandrel 12 is hardcoat anodized and includes a TEFLON® coating as the release coat.

Alternately, mandrel 12 can be formed of a plastic such as polyurethane formulated to have the required strength and wear characteristics. Furthermore, such plastics could be formulated to incorporate a release agent to allow ease of non-stick sliding of the liner on mandrel 12 and to allow ease of removal of any excess adhesive which should remain on mandrel 12. In addition to potential savings in the fabrication of mandrel 12, plastic mandrels 12 would be of lighter weight than aluminum mandrels 12 and would reduce the rotational and torque forces placed upon the turret of the double package forming machine upon which forming blocks 10 are mounted.

End piece 14 is secured to and partially closes open end 30 to provide spaced adhesive pressure strips 58. In the most preferred form, end piece 14 is a rectangular plate corresponding to end 30 and having first and second sides 60 and 62, top 64, and bottom 66. Sides 60 and 62 include stripper grooves 68 in line with and contiguous with stripper grooves 34 of mandrel 12. Likewise, top 64 includes a flap groove 70 in line with and contiguous with flap groove 32 of mandrel 12. The opposite sides of the outside face 72 opposite to mandrel 12 includes flap grooves 74 of a size for receipt of the bottom dust flaps attached to the ends of the carton and which are secured to the bottom flaps attached to the front and back of the carton.

Apertures 76 extend through end piece 14 for providing air communication to the hollow interior of core 16 of mandrel 12. Apertures 76 are arranged to form spaced, parallel strips 58 therebetween. In the most preferred form, the carton adhesive is applied to the blank in lines which are parallel to top 64 and bottom 66 when the bottom of the carton is formed, such that strips 58 are linear extending between sides 60 and 62 and located to be overlaid by the carton and liner with the adhesive of the bottom of the carton located in line with strips 58. Specifically, in the preferred form, six apertures 76 are provided in a parallel arrangement, with the four outside apertures 76 being of a generally rectangular configuration and with the two central apertures 76 being of a generally square configuration. Further, in the preferred form, the ends of apertures 76 along sides 60 and 62 decrease in size from face 72 to mandrel 12, with the thickness between apertures 76 and sides 60 and 62 of end piece 14 being generally equal to the thickness of sides 22 and 24 at the face of end piece 14 abutting with core 16 of mandrel 12. The corners between sides 60 and 62, top 64, bottom 66, and face 72 may be chamfered in a similar manner as between sides 22 and 24, top 26, and bottom 28 of core 16 of mandrel 12. End piece 14 may be secured in any suitable manner such as by bolts 78 extending through suitable apertures formed in end piece 14 and threadably received in core 16 of mandrel 12.

In the most preferred form, end piece 14 is one integral piece formed of hardened steel machined to the preferred configuration. End piece 14 can include a suitable, non-flaking coating to allow ease of non-stick sliding of the liner.

It can be appreciated that vent holes 40 and apertures 76 provide communication of ambient air from the hollow interior of core 16 to the interior of the liner of the double package and at an air flow rate generally equal to the air flow allowed through the hollow interior of core 16 and interconnecting portion 20.

Now that the basic construction of forming block 10 according to the preferred teachings of the present invention has been explained, the operation of forming block 10 in the double package forming machines can be set forth and appreciated. Specifically, when the formed package is being removed from block 10 by stripper bars 38, the piston effect of block 10 sliding from the formed package is eliminated. Particularly, as the formed package is withdrawn from block 10, ambient air is allowed to flow to the void between end piece 14 and the bottom of the formed double package through apertures 76 and vent holes 40, through the hollow interiors of core 16 and interconnecting portion 20, and through apertures 56 and through stripper grooves 34 and 68. Since air flow into the double package as forming block 10 moves out of the double package is only slightly restricted by the cross sectional areas of end piece 14, core 16, and interconnecting portion 20, a vacuum is not created in the void which would otherwise tend to collapse the liner of the double package.

Additionally, the chamfered corners of mandrel 12 and end piece 14, the release coat of mandrel 12 and coating of end piece 14, and the taper of mandrel 12 also assure the release and removal of the double package from forming block 10 without collapse of the liner of the double package.

It can be appreciated that forming block 10 according to the preferred teachings of the present invention eliminates the need for compressed air to force the double package from forming block 10. This is particularly advantageous because the control mechanisms for turning the air flow on and off in sync with stripper bars 38 is no longer necessary and problems arising when the air was out of sync are eliminated. Likewise, the hardware necessary to plumb the air flow through the forming block and the mass associated therewith are also eliminated. The hollow nature of core 16 and interconnecting portion 20 also eliminates mass especially at the free ends of forming block 10 to reduce the rotational and torque forces placed upon the turret of the double package forming machine upon which forming blocks 10 are mounted.

Furthermore, as compressed air is not necessary, the cost in electricity or other energy in producing such compressed air is eliminated. Likewise, other problems created by the quality of compressed air such as contamination from oil or the like carried by the compressed air are also eliminated.

Due to the ease of removal of the double package from forming block 10 according to the teachings of the present invention without encountering problems of liner collapse as occurred with prior forming blocks, a tighter wrap of the liner and carton can be provided around forming block 10 to create a higher quality and more consistent package. Consistent and high quality packages result in better packaging of the cereal, foodstuff, or the like and less consumer complaints relating thereto such as stale product, erroneous suspicion of a tampered product, or like complaints resulting from improperly sealed liners, with collapse of the liner being a major cause of improperly sealed liners.

It can be further appreciated that forming block 10 according to the teachings of the present invention has no moving parts, requires no maintenance or adjustment, and is very durable. In this regard, prior forming blocks had removable wear plates at least at the corner of the forming block over which the side flap of the carton extended. Such wear plates are not utilized in forming block 10, thus eliminating this separable component, the screws utilized for securement, and the tapped holes in the forming block as well as the problems associated therewith such as unintentional separation of the wear plate during use of the forming blocks. Further, if it should become necessary to remove or replace forming block 10 on the double package forming machine, one person can lift and carry forming block 10 due to the reduced weight from prior forming blocks which required two persons to lift and carry.

The use of stripper grooves 34 is further advantageous in that it allows the remaining portions of sides 22 and 24 to be flat. Thus, pressure may be easily applied such as by roller on the front and back of the carton to spread and adhere the lines of adhesive between the front and back of the carton and the liner. The ribbed outer surface of prior forming blocks made the application of such pressure more difficult. Although the ribbed outer surface did allow some air communication around the perimeter of prior forming blocks, the degree of communication provided was minimal compared to that provided b-y stripper grooves 34. Further, vent holes 40 located in stripper grooves 34 also allow ambient air to travel from the interior of mandrel 12 to intermediate mandrel 12 and the liner of the double package through stripper grooves 34.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. In a machine for forming double packages, with the double packages including a liner enclosed within a carton, an improved forming block comprising, in combination: a mandrel for securement to the double package forming machine in a cantilever manner to include a free end, with the mandrel including a core extending inwardly from the free end of the mandrel, with the core having a periphery of a size and shape corresponding to the double package, with the liner and the carton being formed on the periphery of the core, with the core being hollow and having an interior with a cross section of a size substantial to the cross section of the double package; first means for providing communication of ambient air to the interior of the core, with the first communication providing means allowing air flow generally equal to the air flow allowed through the interior of the core; and second means adjacent the free end for providing communication of ambient air from the interior of the core to the interior of the liner of the double package, with the second communication providing means allowing air flow generally equal to the air flow allowed through the interior of the core and the first communication providing means, with the air flow through the first and second communication providing means and the interior of the core preventing the creation of a vacuum within the double package when the double package is stripped for the forming block, wherein the free end of the core is open; wherein the second communication providing means comprises, in combination: an end piece secured to the free end of the core, and at least first and second apertures formed in the end piece allowing air flow from the interior of the core to the interior of the double package, with strips being formed in the end piece between the apertures against which pressure can be placed for adhering the adhesive of the carton, with the end piece including an outside face, and wherein the outside face of the end piece includes first and second flap grooves of a size complementary to and for receipt of the bottom flaps of the carton to allow the bottom of the carton to be generally flat in the formed double package.

2. The machine of claim 1 wherein the second communication providing means comprises at least a first vent hole extending through the periphery of the core adjacent to the free end.

3. The machine of claim 2 wherein the periphery of the core includes a groove, with the vent hole located in air communication with the groove.

4. The machine of claim 3 wherein the double package forming machine includes a stripper bar having a hook for engaging the top edges of the carton; wherein the groove of the periphery of the core is longitudinal and has a width at least equal to the hook, with the stripper bar being movable longitudinally along the core with the hook located within the extent of the groove to strip the double package from the forming block without the stripper bar and hook engaging the core.

5. The machine of claim 1 wherein the mandrel includes a top and at least a first side, wherein the periphery of the top includes a flap groove of a size complementary to and for receipt of the side flap of the carton to allow the side of the carton to be generally flat in the formed double package.

6. In a machine for forming double packages, with the double packages including a liner enclosed within a carton, an improved forming block comprising, in combination: a mandrel for securement to the double package forming machine in a cantilever manner to include a free end, with the mandrel including a core extending inwardly from the free end of the mandrel, with the core having a periphery of a size and shape corresponding to the double package, with the liner and the carton being formed on the periphery of the core, with the core being hollow and having an interior with a cross section of a size substantial to the cross section of the double package; first means for providing communication of ambient air to the interior of the core, providing means allowing air flow generally equal to the air flow allowed through the interior of the core; and second means adjacent the free end for providing communication of ambient air from the interior of the core to the interior of the liner of the double package, with the second communication providing means allowing air flow generally equal to the air flow allowed through the interior of the core and the first communication providing means, with the air flow through the first and second communication providing means and the interior of the core preventing the creation of a vacuum within the double package when the double package is stripped from the forming block; wherein the second communication providing means comprises at least a first vent hole extending through the periphery of the core near the free end.

7. The machine of claim 6 wherein the second communication providing means comprises at least first and second apertures formed in the free end of the mandrel allowing air flow from the interior of the core to the interior of the double package, with strips being formed between the apertures against which pressure can be placed for adhering the adhesive of the carton.

8. The machine of claim 6 wherein the periphery of the core includes a groove, with the vent hole located in air communication with the groove.

9. The machine of claim 8 wherein the double package forming machine includes a stripper bar having a hook for engaging the top edges of the carton; wherein the groove of the periphery of the core is longitudinal and has a width at least equal to the hook, with the stripper bar being movable longitudinally along the core with the hook located within the extent of the groove to strip the double package from the forming block without the stripper bar and hook engaging the core.

10. The machine of claim 7 wherein the free end of the core is open; and wherein the second communication providing means comprises an end piece secured to the free end of the core, with the first and second apertures and the strips being formed in the end piece.

11. The machine of claim 10 wherein the end piece includes an outside face, and wherein the outside face of the end piece includes first and second flap grooves of a size complementary to and for receipt of the bottom flaps of the carton to allow the bottom of the carton to be generally flat in the formed double package.

12. The machine of claim 11 wherein the core includes a top and at least a first side, wherein the periphery of the top includes a flap groove of a size complementary to and for receipt of the side flap of the carton to allow the side of the carton to be generally flat in the formed double package.

13. In a machine for forming double packages, with the double packages including a liner enclosed within a carton, with the carton including an open end defined by top edges, with the double package forming machine including a stripper bar having a hook having a width for engaging the top edges of the carton, an improved forming block comprising, in combination: a mandrel for securement to the double package forming machine in a cantilever manner to include a free end, with the stripper bar being reciprocally movable relative to the mandrel along a longitudinal path from beyond the free end of the mandrel longitudinally along the mandrel and back beyond the free end of the mandrel; and a longitudinal groove formed in the mandrel and having a width at least equal tot eh width of the hook of the stripper bar and a length at least equal to the longitudinal extent of the longitudinal path, with the longitudinal groove located on the mandrel in the longitudinal path of the stripper bar, with the longitudinal groove providing air communication between the liner of the double package and the mandrel to offset the vacuum created when the double package is stripped from the forming block and allowing movement of the stripper bar without engaging the mandrel, wherein the free end of the mandrel includes an outside face, and wherein the outside face of the free end of the mandrel includes first and second flap grooves of a size complementary to and for receipt of the bottom flaps of the carton to allow the bottom of the carton to be generally flat in the formed double package.

14. The machine of claim 13 further comprising, in combination: means for providing air communication of ambient air through the interior of the mandrel to adjacent the free end of the mandrel to offset the vacuum created when the double package is stripped from the forming block.

15. The machine of claim 3 wherein the mandrel includes a top and at least a first side, wherein the periphery of the top includes a flap groove of a size complementary to and for receipt of the side flap of the carton to allow the side of the carton to be generally flat in the formed double package.

16. In a machine for forming double packages, with the double packages including a liner enclosed within a carton, with the carton including an open end defined by top edges, with eh double package forming machine including a stripper bar having a hook having a width for engaging he top edges of the carton, an improved forming block comprising, in combination: a mandrel for securement to the double package forming machine in a cantilever manner to include a free end, with the stripper bar being reciprocally movable relative to the mandrel along a longitudinal path from beyond the free end of the mandrel longitudinally along the mandrel and back beyond the free end of the mandrel; a longitudinal groove formed in the mandrel and having a width at least equal to the width of the hook of the stripper bar and a length at least equal to the longitudinal extend of the longitudinal path, with the longitudinal groove located on the mandrel in the longitudinal path of the stripper bar, with the longitudinal groove providing air communication between the liner of the double package and the mandrel to offset the vacuum created when the double package is stripped form the forming block and allowing movement of the stripper bar without engaging the mandrel; and means for providing air communication of ambient air through the interior of the mandrel to adjacent the free end of the mandrel to offset the vacuum created when the double package is stripped from the forming block, wherein the air communication providing means provides air communication to the longitudinal groove.

17. The machine of claim 16 wherein the air communication providing means includes a vent hole extending through the mandrel, with the vent hole having a diameter generally equal to the width of the groove and located within the extent of the groove.

18. The machine of claim 16 wherein the free end of the mandrel is generally open; and wherein the air communication providing means provides air communication through the free end of the mandrel.

19. The machine of claim 18 wherein the free end of the mandrel includes an outside face, and wherein the outside face of the free end of the mandrel includes first and second flap grooves of a size complementary to and for receipt of the bottom flaps of the carton to allow the bottom of the carton to be generally flat in the formed double package.

20. The machine of claim 19 wherein the mandrel includes a top and at least a first side, wherein the periphery of the top includes a flap groove of a size complementary to and for receipt of the side flap of the carton to allow the side of the carton to be generally flat in the formed double package.

* * * * *